US006673466B2

(12) United States Patent
Brück et al.

(10) Patent No.: US 6,673,466 B2
(45) Date of Patent: Jan. 6, 2004

(54) HOUSING WITH A PASSIVATION LAYER, CATALYST CARRIER BODY WITH A HOUSING AND METHOD FOR PRODUCING A CATALYST CARRIER BODY WITH SUCH A HOUSING

(75) Inventors: Rolf Brück, Bergisch Gladbach (DE); Ludwig Wieres, Overath (DE); Ferdi Kurth, Mechernich (DE); Karl-Josef Schmitz, Engelskirchen (DE); Hans-Günter Faust, Köln (DE); Jan Hodgson, Neunkirchen-Seelscheid (DE)

(73) Assignee: EMITEC Gesellschaft fuer Emissionstechnologies mbH, Lohmar (DE)

( * ) Notice: Subject to any disclaimer, the term of this patent is extended or adjusted under 35 U.S.C. 154(b) by 0 days.

(21) Appl. No.: 10/271,421

(22) Filed: Oct. 15, 2002

(65) Prior Publication Data

US 2003/0049484 A1 Mar. 13, 2003

Related U.S. Application Data

(63) Continuation of application No. PCT/EP01/04220, filed on Apr. 12, 2001.

(30) Foreign Application Priority Data

Apr. 14, 2000 (DE) ..... 100 18 641
May 30, 2000 (DE) ..... 100 26 697

(51) Int. Cl.[7] ..... B32B 3/12; F01N 3/28; B01J 35/04

(52) U.S. Cl. ..... 428/593; 422/180; 502/527.22; 228/118; 228/181; 29/890

(58) Field of Search ..... 428/593, 629, 428/472.2, 594, 632, 627; 228/118, 181, 211; 422/180; 502/527.22; 29/890

(56) References Cited

U.S. PATENT DOCUMENTS

| | | | | | |
|---|---|---|---|---|---|
| 4,694,864 | A | * | 9/1987 | Libin | 138/113 |
| 5,304,351 | A | * | 4/1994 | Tanaka et al. | 422/180 |
| 5,403,558 | A | * | 4/1995 | Kono et al. | 422/179 |
| 5,894,053 | A | | 4/1999 | Fried | 428/548 |
| 6,425,517 | B1 | * | 7/2002 | Wieres et al. | 228/248.1 |

FOREIGN PATENT DOCUMENTS

| | | | |
|---|---|---|---|
| DE | 31 19 289 | A1 | 3/1982 |
| DE | 195 07 299 | A1 | 9/1996 |
| DE | 198 03 012 | A1 | 7/1999 |
| DE | 10018641 | A1 * | 10/2001 |
| EP | 0 486 276 | A1 | 5/1992 |
| JP | 55-126365 | * | 9/1980 |
| JP | 07-016476 | * | 1/1995 |
| JP | 07-328451 | * | 12/1995 |
| WO | WO 98/15354 | | 4/1998 |
| WO | WO 99/37896 | | 7/1999 |

* cited by examiner

*Primary Examiner*—John J. Zimmerman
(74) *Attorney, Agent, or Firm*—Laurence A. Greenberg; Werner H. Stemer; Ralph E. Locher

(57) ABSTRACT

A housing for a honeycomb body includes a jacket tube with an inner wall surface. The jacket tube has a passivation layer in at least one section of the inner wall surface in order to deliberately modify a connection to the honeycomb body by joining. A method for the production of a catalyst carrier body with a honeycomb body and a housing according to the invention are also indicated. A catalyst carrier body produced in this way reduces thermal stresses between the honeycomb body and the jacket tube and, in particular, ensures a reliable brazing process during production, even in a vacuum.

23 Claims, 3 Drawing Sheets

HOUSING WITH A PASSIVATION LAYER, CATALYST CARRIER BODY WITH A HOUSING AND METHOD FOR PRODUCING A CATALYST CARRIER BODY WITH SUCH A HOUSING

CROSS-REFERENCE TO RELATED APPLICATION

This application is a continuation of copending International Application No. PCT/EP01/04220, filed Apr. 12, 2001, which designated the United States and was not published in English.

BACKGROUND OF THE INVENTION

Field of the Invention

The present invention relates to a housing, in particular having a jacket tube, for a honeycomb body, a catalyst carrier body with a housing and a method for producing a catalyst carrier body with such a housing. Such catalyst carrier bodies with a housing are preferably used in exhaust systems of internal combustion engines, especially those of motor vehicles.

International Publication No. WO 99/37896 has described a method for the production of a honeycomb body surrounded by a jacket tube. The honeycomb body and the jacket tube have different thermal expansion behaviors due to differences in the properties of their materials and due to differences in temperature during operation. The aim is therefore to avoid a rigid connection between the honeycomb body and the jacket tube in at least one end region of the honeycomb body or at least in certain partial regions. For that reason, the jacketed honeycomb body described in International Publication No. WO 99/37896 is embodied with a sleeve, which is intended to ensure that direct brazed joints between the honeycomb body and the jacket tube are avoided in the at least one end region of the honeycomb body, despite manufacturing tolerances in the jacket tube and the honeycomb body. The use of a sleeve leads to a significant reduction in thermal stresses between the jacket tube and the honeycomb body but results in a higher outlay on production.

Measures that prevent a connection between metal surfaces during high-temperature processing (e.g. sintering or brazing) are also known. Those generally contain fine ceramic particles, a binder and a proportion of diluent and solvent. The binder, the diluent and the solvent are volatile even at relatively low temperatures. When producing catalyst carrier bodies, the connection between the jacket tube and the housing is preferably formed in a vacuum. The tendency of those agents to volatilize makes it significantly more difficult to maintain the vacuum and poses the risk that the system will be contaminated by volatile components.

SUMMARY OF THE INVENTION

It is accordingly an object of the invention to provide a housing with a passivation layer, a catalyst carrier body with a housing and a method for producing a catalyst carrier body with such a housing, which overcome the hereinaforementioned disadvantages of the heretofore-known devices and methods of this general type and in which the housing allows selective connection by joining to compensate for differences in expansion behavior of a honeycomb body and a jacket tube and ensures permanent fixing of the honeycomb body, in an exhaust system, for example.

With the foregoing and other objects in view there is provided, in accordance with the invention, a housing for a honeycomb body, comprising a jacket tube with an inner wall surface, and a passivation layer in at least one section of the inner wall surface of the jacket tube for deliberately preventing connection to the honeycomb body by joining.

The passivation layer is thermally very stable and prevents any connection by joining of the metal surfaces that are in contact with one another. The section to which the passivation layer has been applied is situated at a location on the jacket tube at which relative motion between the honeycomb body and the jacket tube during subsequent operation of the catalyst carrier body is desired in order to prevent thermal stresses. This is preferably the end region in which the hot exhaust gas strikes the catalyst carrier body. Areas that are further inward can also be kept free of joints in this way.

Due to its insulating property, the passivation layer furthermore prevents conduction of heat from the honeycomb body to the jacket tube. This is particularly important, for example, if the light-off or activation temperature of a catalytic converter, at which effective cleaning of the exhaust gas takes place, is to be reached after as short as possible a time following the starting of a motor vehicle.

In accordance with another feature of the invention, the passivation layer is constructed as a surface oxide layer. Oxides, in particular metal oxides, have a high thermal stability, which prevents mutually-contacting metal surfaces from bonding together. It is likewise particularly advantageous that the oxides can be produced in a simple manner with components of the material of the jacket tube and that an additional material is not required for the production of the passivation layer. A metal oxide layer of this kind can also be produced, for example, simply by roughening the inner wall surface of the jacket tube in this section.

In accordance with a further feature of the invention, the passivation layer is embodied as an applied ceramic layer, in particular one involving aluminum oxide. Ceramic particles are distinguished by particularly strong forces of attraction to one another and very good thermodynamic stability. A ceramic layer composed of titanium oxide or magnesium oxide is likewise possible.

In accordance with an added feature of the invention, the passivation layer is constructed as an all-round strip. This ensures that brazed joints between the jacket tube and the honeycomb body are avoided in this section over the entire circumference of the jacket tube and enables differences in expansion behavior to be compensated for.

In accordance with an additional feature of the invention, the housing is oval or elliptical in shape, and the passivation layer is placed in a more-sharply-curved jacket-tube section. An oval shape of the housing is required, for example, if the installation of a catalyst carrier body together with the housing has to satisfy particular spatial constraints within an exhaust system. Experience has shown that it is advantageous to make the joints on the flat sides of such a structure and therefore to prevent joints on the rounded sides through the use of a passivation layer. This is, in particular, an additional measure to any passivation layer at one or both ends.

In accordance with yet another feature of the invention, the passivation layer has an axial length of 5 mm to 50 mm. This enables the housing to be adapted precisely to the respective application. If, for example, the housing is disposed relatively close to an internal combustion engine or the thermal expansion behavior of the honeycomb body and the jacket tube differ very greatly, the passivation layer is embodied with a longer axial length.

It is particularly advantageous if the passivation layer has a thickness of 0.03 mm to 0.12 mm. In particular, this enables manufacturing tolerances of the honeycomb body and the jacket tube to be compensated for in the assembled condition.

In accordance with yet a further feature of the invention, an adhesive layer is disposed between the jacket tube and the ceramic layer. This is advantageous particularly when the ceramic layer is exposed to high dynamic loading. The adhesive layer enables the ceramic layer to be bonded permanently to the metallic surface of the jacket tube.

In accordance with yet an added feature of the invention, there is provided a layer of brazing material placed on the passivation layer of the jacket tube before assembly with a honeycomb body. The passivation layer does admittedly prevent the formation of brazed joints between the honeycomb body and the jacket tube. However, if the honeycomb body is made up, for example, of a multiplicity of layers of sheet metal produced by winding and/or stacking, the brazing material disposed on the passivation layer can be used to ensure a brazed joint between adjacent ends of the layers of sheet metal. In this way, flapping of end regions of the layers of sheet metal is avoided and the service life of a honeycomb body of this kind is increased.

In accordance with yet an additional feature of the invention, there is provided an all-around layer of brazing material on the passivation layer. In particular, this has the effect of brazing all adjacent layers of sheet metal to one another.

With the objects of the invention in view, there is also provided a catalyst carrier body, comprising a housing according to the invention and a honeycomb body disposed in the housing. The honeycomb body includes layers of sheet metal that are at least in part structured in such a way that the honeycomb body has channels through which an exhaust gas can flow. The jacket tube at least partially surrounds the honeycomb body and is connected to the honeycomb body by joining in at least one axial partial region. The selective connection of the honeycomb body and the jacket tube by a joining technique ensures that the catalyst carrier body has a long service life.

In accordance with another feature of the invention, the ceramic passivation layer is placed close to an end surface of the honeycomb body. If the catalyst carrier body is aligned in an exhaust system, with the section having the ceramic layer pointing toward the hot exhaust gas (upstream), the catalyst carrier body compensates for high thermal stresses in a particularly effective manner.

In accordance with a further feature of the invention, radially outer end regions of the layers of sheet metal of the honeycomb body rest against the ceramic layer. It is thus possible to reduce flapping of these radially outer end regions. It is particularly advantageous to connect the contacting end regions to one another by joining. This ensures a long service life even in the case of extreme dynamic loads.

In accordance with an added feature of the invention, the honeycomb body is brazed to the jacket tube, preferably by high-temperature vacuum brazing.

With the objects of the invention in view, there is also provided a method for the production of a catalyst carrier body having a honeycomb body and a jacket tube. The honeycomb body is made up of layers of sheet metal that are at least in part structured in such a way that the honeycomb body has channels through which an exhaust gas can flow. The jacket tube has an inner wall surface that at least partially surrounds the honeycomb body and is brazed to the honeycomb body in at least one axial partial region. The jacket tube has a passivation layer in at least one section of the inner wall surface for deliberate prevention of a brazed joint with the honeycomb body. The production method includes the following steps:

A jacket tube is produced and a passivation layer is then formed on the inner wall surface of the jacket tube in at least one section. A brazed joint between the jacket tube and the honeycomb body is prevented in this section during a subsequent brazing process. This section is preferably disposed close to an end surface of the honeycomb body in the inserted condition. The inner wall surface of the jacket tube is then supplied with brazing material.

The honeycomb body is formed in a known manner by stacking and/or winding layers of sheet metal, which are at least in part structured in such a way that the honeycomb body has channels through which an exhaust gas can flow. The honeycomb body is then introduced into the jacket tube. The brazed joints are then formed. In this way, it is possible to produce a catalyst carrier body which, on one hand, is distinguished by permanent connection of the honeycomb body and the jacket tube and, on the other hand, also allows compensation of differences between the expansion behavior of the honeycomb body and the jacket tube. At the same time, no vapors or gases that would impair formation of brazed joints, especially in a vacuum, are formed during the brazing process.

In accordance with another mode of the invention, the passivation layer is produced by selective, spatially limited heating of the at least one section. Accordingly, this section of the housing is heated to a certain temperature and, if appropriate, also held at this temperature to allow diffusion processes in the material and on the inner wall surface of the housing. Ferritic materials containing aluminum and chromium, in particular, are suitable in this respect, being heated to a temperature above 1100° C. During this process, metal particles, especially aluminum, pass from the inside into the vicinity of the inner wall surface of the jacket tube and then react with the oxygen particles in the environment to provide the desired passivation layer. The passivation layer can accordingly be produced without an additional material.

In accordance with a further mode of the invention, the at least one section is heated by induction. The inductive heating method produces spatially limited eddy currents that lead to heating of the section due to electrical resistance of the material. In addition to the fact that inductive heating allows good definition of the area to be heated, this method is suitable for production of large numbers in rapid succession.

In accordance with an added mode of the invention, the at least one section is supplied with a stream of oxygen-containing gas during the production of the passivation layer. In this way, a rich supply of oxygen molecules, which are required in the formation of a surface oxide layer, is ensured at the inner wall surface. The formation of a passivation layer is greatly promoted as a result.

In accordance with an additional mode of the invention, the jacket tube is supplied with a stream of a noble gas, in particular argon, outside the at least one section during the production of the passivation layer. In this case, the noble gas prevents formation of the oxide layer because the noble gas does not react with the metal particles of the jacket tube and displaces the atmospheric oxygen.

In accordance with yet another mode of the invention, the passivation layer is produced by chemical treatment of the at least one section. For this purpose, the section is treated with a chemical that leads to the formation of a surface oxide layer. This method step is suitable particularly in the case of jacket tubes produced with very close manufacturing tolerances in relation to the honeycomb body to be accommodated. Heat treatment without the honeycomb body and therefore thermal distortion can be avoided.

In accordance with yet a further mode of the invention, the passivation layer is produced by applying an applied ceramic layer, in particular aluminum oxide.

In accordance with yet an added mode of the invention, there is provided an adhesive layer applied to the relevant section of the inner wall surface of the jacket tube before the formation of the ceramic layer. This leads to a particularly robust connection between the ceramic layer and the jacket tube. This adhesive layer preferably has no volatile components to ensure that the brazing process is reliable.

In accordance with yet an additional mode of the invention, the ceramic layer is formed on the jacket tube by flame spraying. Flame spraying is distinguished by particularly uniform distribution of the ceramic layer on the inner wall surface of the jacket tube, thereby avoiding pressure peaks in the jacket tube due to the metal layers being in contact.

In accordance with again another mode of the invention, an adhesive is applied, in particular to the ceramic layer, before the inner wall surface of the jacket tube is supplied with brazing material, to produce a layer of brazing material. The purpose of the adhesive is to fix the powdered brazing material at those points of the jacket tube at which a brazed joint is to be formed during the subsequent brazing process. In this case, the adhesive on the ceramic layer ensures that there is powdered brazing material in the area of the honeycomb body in which a connection to the jacket tube is unwanted. This layer of brazing material serves for the subsequent brazing together of adjacent layers of sheet metal of the honeycomb body.

In accordance with again a further mode of the invention, powdered brazing material is applied to the end of the honeycomb body before or after the introduction of the honeycomb body into the jacket tube. In this way, the end regions of the layers of sheet metal close to the end are brazed together and the service life of a catalyst carrier body produced in this way is increased.

In accordance with again an added mode of the invention, the passivation layer is produced by roughening the inner wall surface in the at least one section.

In accordance with a concomitant mode of the invention, the roughening is performed by the production methods of sandblasting and/or brushing. Surprisingly, the resulting roughness of the inner wall surface prevents wetting by a brazing material in this section, thus preventing a connection between the honeycomb body and the jacket tube by joining. The passivation layer specified can thus be produced in a particularly economical manner.

Other features which are considered as characteristic for the invention are set forth in the appended claims.

Although the invention is illustrated and described herein as embodied in a housing with a passivation layer, a catalyst carrier body with a housing and a method for producing a catalyst carrier body with such a housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
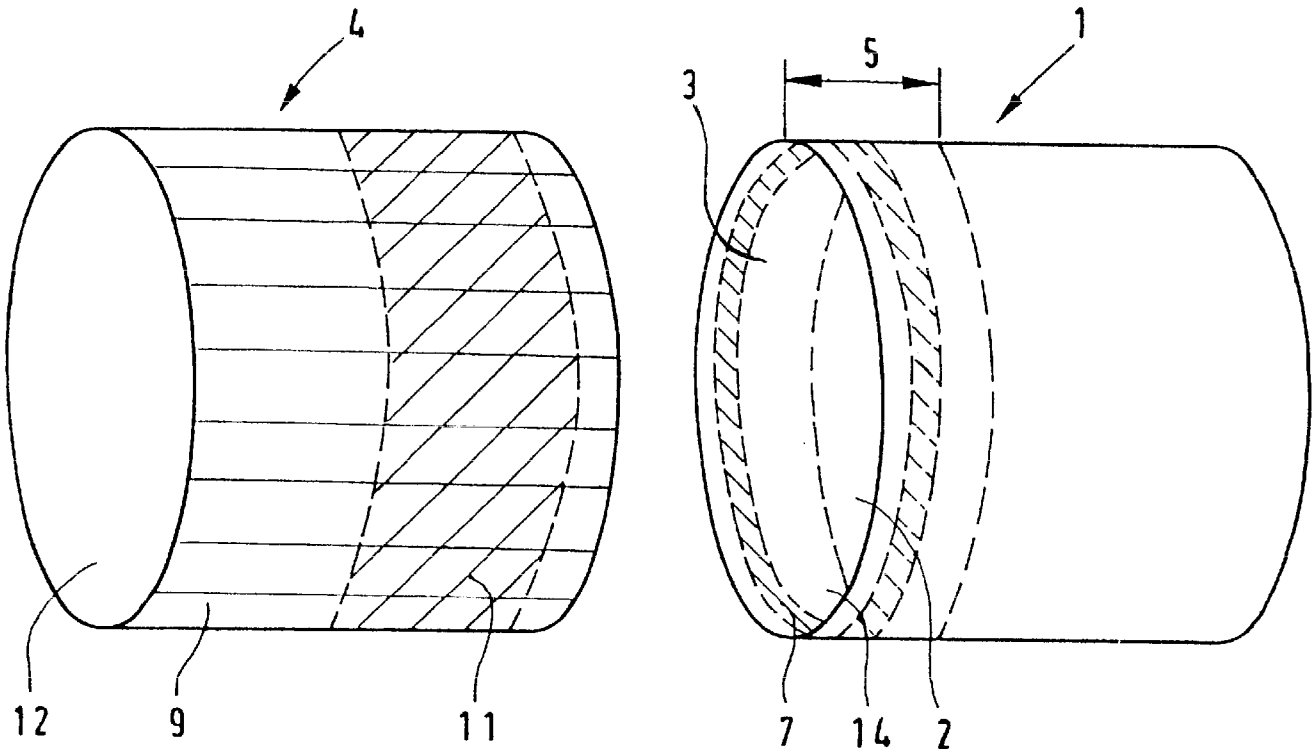
FIG. 1 is a diagrammatic, exploded, perspective view of a jacket tube and a honeycomb body of a catalyst carrier body according to the invention.

Referring now to the figures of the drawings in detail and first, particularly, to FIG. 1 thereof, there is seen a honeycomb body 4 with an end 12. The honeycomb body has a plurality of layers 9 of sheet metal produced by winding and/or stacking. The honeycomb body 4 is inserted into a jacket tube 1. The jacket tube 1 has an inner wall surface 2, which has a section 14 with a passivation layer 3. The section 14, which has a length 5, is disposed close to the end surface 12 of the honeycomb body 4 in an assembled state of the catalyst carrier body. A layer 7 of brazing material is additionally shown on the section 14.

Once the honeycomb body 4 has been introduced into the jacket tube 1, brazed joints are formed. The honeycomb body 4 is then connected to the jacket tube 1 by joining in a partial region 11. The passivation layer 3 prevents the honeycomb body 4 from being connected to the jacket tube 1 in the section 14, allowing differences in thermal expansion behavior to be compensated for in this section 14. The layer 7 of brazing material ensures that the layers 9 of sheet metal are connected to one another.

Figure 2:
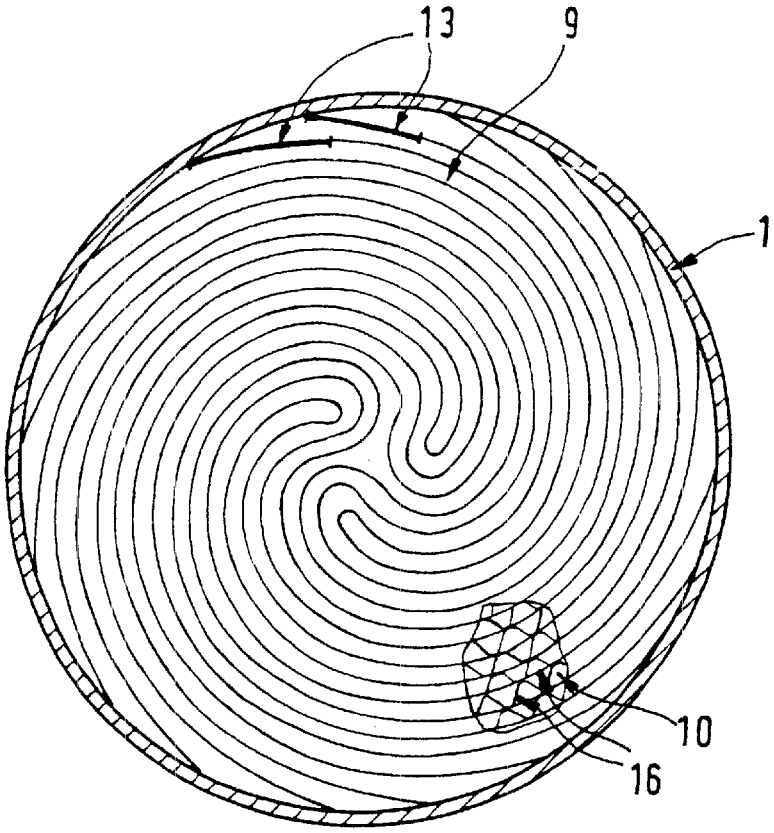
FIG. 2 is a partly-sectional, end-elevational view of an assembled embodiment of a catalyst carrier body according to the invention.

FIG. 2 shows an end view of the catalyst carrier body according to the invention. The jacket tube 1 surrounds the multiplicity of layers 9 of sheet metal, which have end regions 13 resting against the jacket tube 1. The layers of sheet metal have corrugated and smooth sheets 16, which are disposed in such a way that channels 10 through which an exhaust gas can flow are formed.

Figure 3:
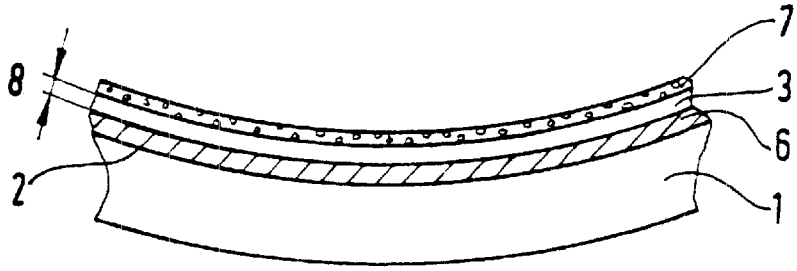
FIG. 3 is a fragmentary, partly-sectional view showing a layered structure of a housing according to the invention.

FIG. 3 diagrammatically shows a structure of a housing according to the invention for a honeycomb body. The figure also shows a configuration of various layers 3, 6, 7 in the section 14 of the jacket tube 1. An adhesive layer 6 which is disposed on the inner wall surface 2 of the jacket tube 1 ensures that the passivation layer 3 is bonded permanently to the jacket tube 1. A thickness 8 of the passivation layer 3 can be varied in accordance with requirements of the catalyst carrier body. A layer 7 of brazing material, which is also illustrated on the passivation layer 3, ensures that adjacent end regions 13 of the layers 9 of sheet metal are connected.

Figure 4:
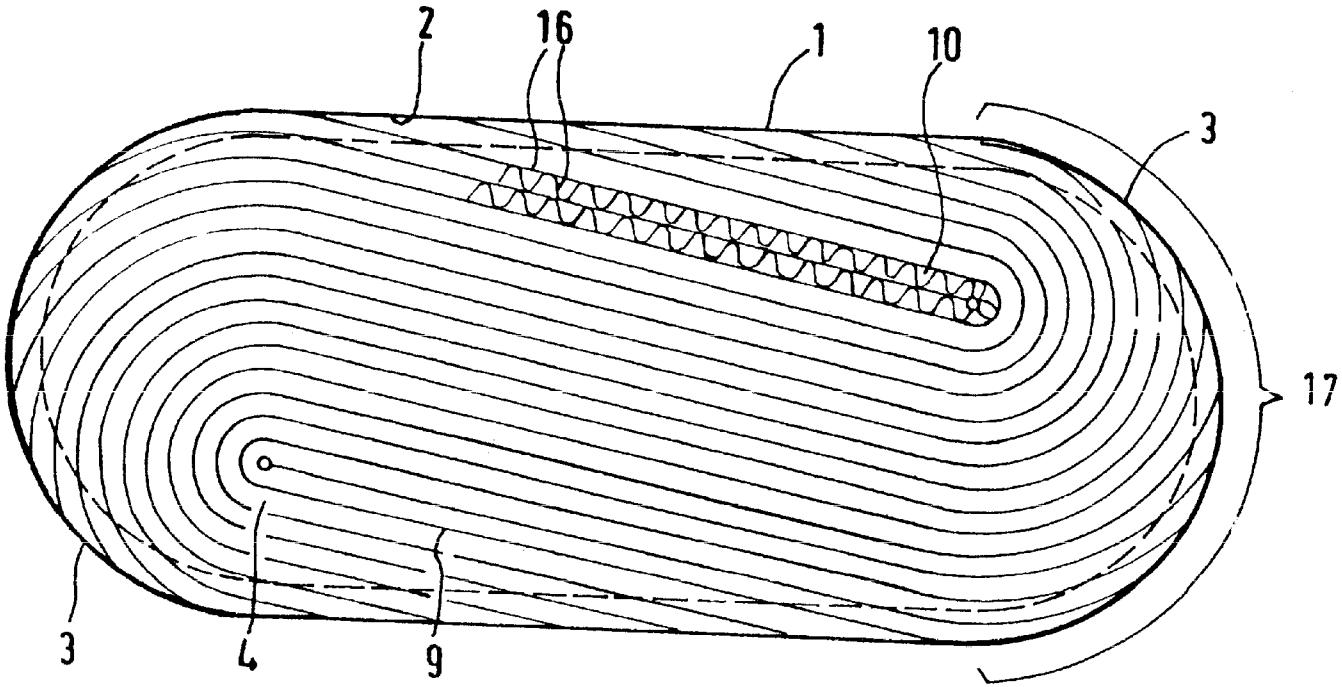
FIG. 4 is an end-elevational view of an embodiment of an oval housing with a honeycomb body and a passivation layer.

FIG. 4 shows a diagrammatic representation of an embodiment of an oval jacket tube 1 with a honeycomb body 4 and a passivation layer 3. The honeycomb body has a plurality of layers 9 of sheet metal produced by winding and/or stacking. The layers are at least partly structured in such a way that they allow an exhaust gas to flow through. The honeycomb body 4 has a multiplicity of channels 10, which are bounded by smooth and/or corrugated sheets 16, and the honeycomb body 4 is surrounded by the jacket tube 1. The jacket tube 1 has an inner wall surface 2, which is provided with the passivation layer 3 in a jacket-tube section 17. The jacket-tube section 17 is a more-sharply-curved area of the oval or elliptical jacket tube 1, in which experience has shown a brazed joint to be disadvantageous.

A catalyst carrier body produced in accordance with the invention makes it possible to compensate for differences in the expansion behavior of the honeycomb body and the jacket tube. The production of a catalyst carrier body of this kind ensures a reliable brazing process, especially in the case of a high-temperature vacuum brazing process.

What is claimed is:

1. In a housing for a honeycomb body, the improvement comprising:

a jacket tube having an inner wall surface with sections;

a passivation layer disposed in at least one of said sections of said inner wall surface for deliberately preventing joining of said jacket tube to the honeycomb body, said passivation layer being an applied ceramic layer; and an adhesive layer being disposed between said jacket tube and said applied ceramic layer.

2. The housing according to claim 1, wherein said ceramic layer has aluminum oxide.

3. The housing according to claim 1, wherein said passivation layer is an all-round strip.

4. The housing according to claim 1, wherein said jacket tube has a shape selected from the group consisting of oval and elliptical, and said jacket tube has a more-sharply-curved jacket-tube section in which said passivation layer is disposed.

5. The housing according to claim 1, wherein said passivation layer has an axial length of from 5 mm to 50 mm.

6. The housing according to claim 1, wherein said passivation layer has a thickness of from 30 $\mu$m to 120 $\mu$m.

7. The housing according to claim 1, including a layer of brazing material disposed on said passivation layer.

8. The housing according to claim 7, wherein said layer of brazing material is an all-round layer on said passivation layer.

9. A method for the production of a catalyst carrier body, which comprises:

forming a honeycomb body with an axial partial region by at least one of stacking and winding layers of sheet metal being at least partly structured to form channels in the honeycomb body through which an exhaust gas can flow;

producing a jacket tube having an inner wall surface with sections;

forming a passivation layer on at least one of the sections of the inner wall surface of the jacket tube, for deliberately preventing a brazed joint between the jacket tube and the honeycomb body by forming an applied ceramic layer at the at least one section of the inner wall surface and applying an adhesive layer to the at least one section before forming the applied ceramic layer;

supplying at least partial regions of the inner wall surface of the jacket tube with brazing material;

introducing the honeycomb body into the jacket tube and at least partially surrounding the honeycomb body with the jacket tube; and forming brazed joints between the jacket tube and the honeycomb body at least in the axial partial region.

10. The method according to claim 9, which further comprises producing the passivation layer by selective, spatially limited heating of the at least one section.

11. The method according to claim 10, which further comprises inductively heating the at least one section.

12. The method according to claim 9, which further comprises supplying the at least one section with a stream of oxygen-containing gas during the production of the passivation layer.

13. The method according to claim 9, which further comprises supplying the jacket tube with a stream of a noble gas outside the at least one section during the production of the passivation layer.

14. The method according to claim 9, which further comprises supplying the jacket tube with a stream of argon gas outside the at least one section during the production of the passivation layer.

15. The method according to claim 9, which further comprises producing the passivation layer by chemical treatment of the at least one section.

16. The method according to claim 9, wherein the applied ceramic layer is an applied aluminum oxide layer.

17. The method according to claim 9, which further comprises flame-spraying the passivation layer as the applied ceramic layer formed on the jacket tube.

18. The method according to claim 9, which further comprises applying an adhesive before supplying the inner wall surface of the jacket tube with brazing material, to produce a layer of the brazing material.

19. The method according to claim 18, which further comprises applying the adhesive to the passivation layer.

20. The method according to claim 9, which further comprises applying powdered brazing material to an end of the honeycomb body before introducing the honeycomb body into the jacket tube.

21. The method according to claim 9, which further comprises applying powdered brazing material to an end of the honeycomb body after introducing the honeycomb body into the jacket tube.

22. The method according to claim 9, which further comprises producing the passivation layer by roughening the inner wall surface in the at least one section.

23. The method according to claim 22, which further comprises performing the roughening step by at least one of sandblasting and brushing.

* * * * *